US005099988A

United States Patent [19]

Garran

[11] Patent Number: 5,099,988

[45] Date of Patent: Mar. 31, 1992

[54] DECORATIVE/ORNAMENTAL CRIB AND KIT AND BLANK FOR ASSEMBLING SAME

[76] Inventor: Joseph F. Garran, 10676 Oak Branch Trail, Strongsville, Ohio 44136

[21] Appl. No.: 672,384

[22] Filed: Mar. 20, 1991

[51] Int. Cl.[5] ..... B65D 5/44

[52] U.S. Cl. ..... 206/223; 206/457; 229/104

[58] Field of Search ..... 206/216, 223, 232, 457, 206/45.14, 45.19; 229/104, 167, 173

[56] References Cited

U.S. PATENT DOCUMENTS 1,493,460 5/1924 Pinkerton ..... 229/104
2,711,281 6/1955 Argodale ..... 229/173
2,723,747 11/1955 Oxenfield ..... 206/45.14
2,748,928 6/1956 Stavis et al. ..... 206/45.14
3,785,480 1/1974 Minasian ..... 206/223
4,055,250 10/1977 Mayhew ..... 206/457
4,662,512 5/1987 Durand ..... 206/45.14
4,712,673 12/1987 Moore ..... 206/232
4,828,114 5/1989 Bardeen ..... 206/232

*Primary Examiner*—Jimmy G. Foster
*Attorney, Agent, or Firm*—Oldham, Oldham & Wilson Co.

[57] ABSTRACT

Blank of stiff sheet material, preferable corrugated cardboard, for forming an ornamental article in the shape of a crib having a headboard, a footboard, and sides; a kit comprising a flexible outer envelope which contains said blank and optionally a strip of decorative lace; and a decorative/ornamental article in the shape of a crib which is assembled from said blank.

8 Claims, 4 Drawing Sheets

DECORATIVE/ORNAMENTAL CRIB AND KIT AND BLANK FOR ASSEMBLING SAME

TECHNICAL FIELD

This invention relates to a decorative or ornamental article which resembles a baby's crib, and to a kit and a blank for assembling the same.

SUMMARY OF THIS INVENTION

It is an object of this invention to provide a decorative/ornamental article in the shape of a baby's crib, which can be readily assembled by a purchaser, who may be either a dealer or the ultimate user.

It is a further object of this invention to provide an attractive and yet inexpensive article in the shape of a baby's crib.

It is still a further object of this invention to provide a decorative article in the shape of a baby's crib which is strong enough to serve as a container for gifts, flowers and the like.

This invention according to a first aspect provides an article in the shape of a baby's or doll's crib comprising a headboard, a footboard, two parallel sides, and a bed which is contained within the area enclosed by the headboard, the footboard and the two parallel sides, and which is assembled from a blank that has been prefolded along fold lines.

A further aspect of this invention is to provide a decorated crib, in which decorative material such as lace is affixed to the outside surfaces of the crib A still further object of this invention is to provide a blank of rigid or semi-rigid material containing fold lines located so that the blank, when folded along these fold lines, will form the aforesaid crib.

DETAILED DESCRIPTION OF THE DRAWINGS

Figure 1:
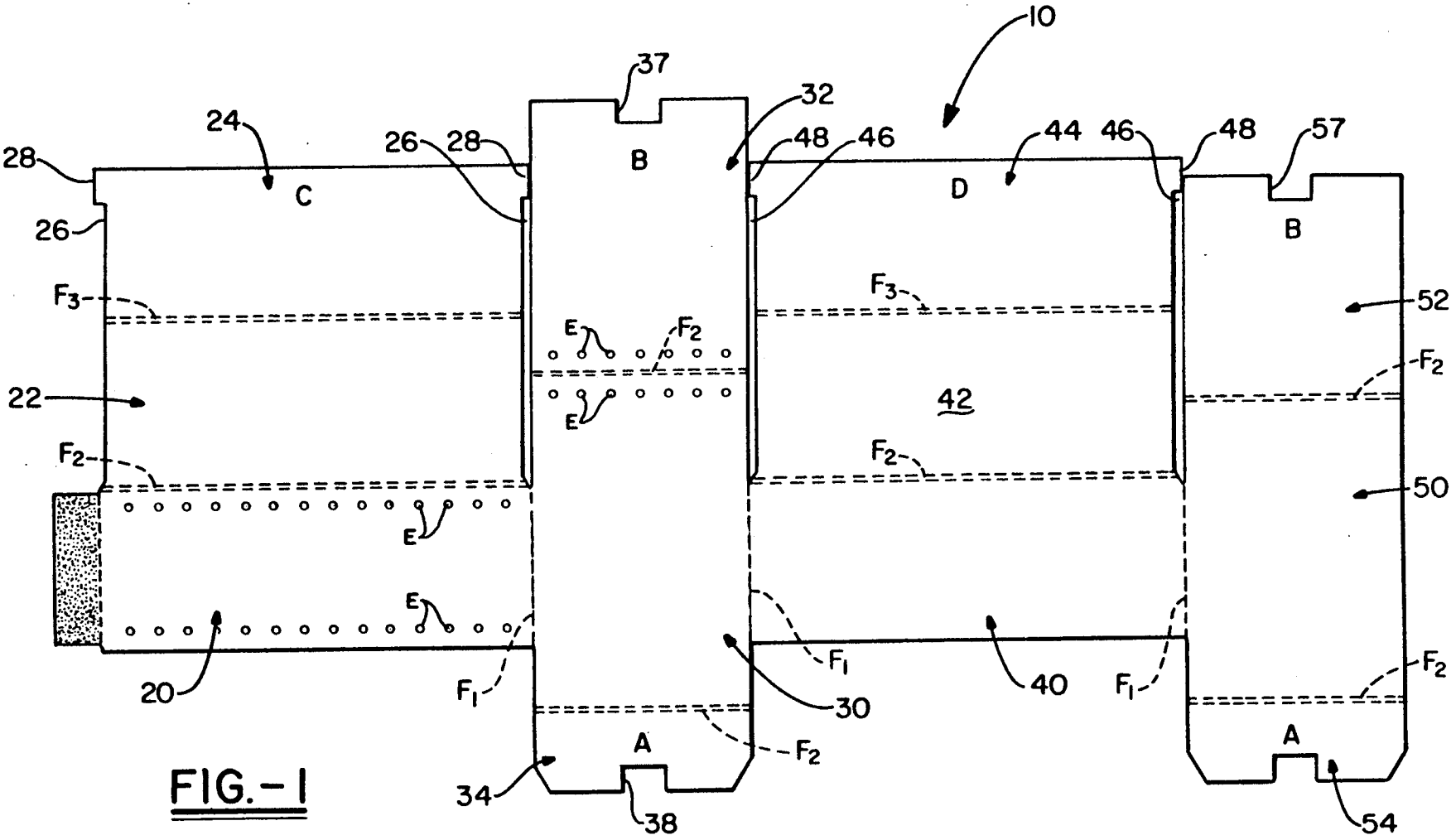
FIG. 1 is a plan view of a blank according to a first and preferred embodiment of this invention.

This invention will now be described in detail with particular reference to the best mode and preferred embodiment thereof.

Blanks 10, 12, 14 and 16, shown in FIGS. 1, 2, 3 and 4, respectively, represent blanks according to different embodiments which can be used to assemble a decorative crib according to this invention. The embodiment shown in FIG. 1, blank 10, represents the preferred embodiment and will be described in detail. The other embodiments will be illustrated in fragmentary views, with the portions which are structurally identical to the corresponding portions of the embodiment of FIG. 1 being for the most part omitted.

Blank 10, 12, 14 or 16 (i.e. a blank according to any of the embodiments herein) is preferably made of corrugated cardboard which is white on one side and brown on the other. One side, which forms all outside surfaces in the assembled crib, is coated with a suitable white coating material primarily for aesthetic reasons, although the coating material (which may be conventional) may also add a certain degree of water resistance to this side. Brown is the natural color of the corrugated cardboard. In general, however, any stiff material, which is stiff enough to hold its shape and support weight and which may be folded along fold lines but not readily folded between fold lines, may be used. In addition to the preferred corrugated cardboard, certain thermoplastic materials, notably "rigid" polyvinyl chloride sheet or corrugated plastic material similar in construction to corrugated cardboard, may be used. The plastic sheet may be provided with plastic hinges at the fold lines.

Certain reference letters will be used in addition to reference numerals in the description herein. Reference letters A, B, C and D may be embossed in panels of a blank according to this invention, at locations to be hereinafter described as an aid in assembly of the crib. Reference letter E represents embossed dots which may be provided along the "glue lines", i.e. the lines along which hot melt glue or adhesive is applied during assembly. Reference letter F, which is always followed by a number, denotes a fold line. "F1" denotes an inward fold of 90° as seen from the brown side of the blank (outward fold as seen from the white side); "F2" denotes an inward fold, (i.e. as seen from the brown side, outward as seen from the white side) of 180°; "F3" denotes an outward fold (inward as seen from the white side) of 90°.

Blank 10 will now be described with reference to FIG. 1. FIG. 1 shows blank 10 brown side up. The brown side is hidden from view in the assembled article, as noted above.

Blank 10 has a plurality of panels which are arranged in four vertically extending columns in side-by-side relationship. Adjacent panels are separated by fold lines. These four columns of panels form as follows: the right side, the headboard, the left side and the footboard, respectively, of the assembled crib.

The left hand column of panels comprises panels 20, 22 and 24, which are vertically aligned. All of these panels are rectangular in shape and extend from left to right, i.e. their width (from left to right as seen in FIG. 1) exceeds their height (in the vertical direction as seen in FIG. 1). Panels 20 and 22 form the outer right side panel and the inner right side panel, respectively, and are separated by a 180° inward fold F2 (since this fold is inward as seen from the brown side, it is outward as seen from the white side, which is the side visible in the finished product). Panels 22 and 24 are separated by a 90° outward fold F3. Panel 24, together with another panel (44) to be described subsequently, forms the bed of the crib. Long narrow slot cutouts 26 are provided on the left and right edges of panels 22 and 24, extending over the entire height of panel 22 and most of the height of panel 24 terminating just short of the upper edge of panel 24. These cutouts 26 provide laterally extending locking tabs 28 along the top edge of panel 24.

The second column of panels includes outer headboard panel 30, inner headboard panel 32, which is above panel 30, and leg panel 34 which is below panel 30. Panel 30 is rectangular, and panels 32 and 34, except for cutouts, are also rectangular. These three panels are aligned along a common vertical centerline. Panels 30, 32 and 34 all have the same width except for cutouts. This width is the desired width of the headboard in the finished crib, and is appreciably less than the width of panels 20, 22 and 24. Panel 30 is separated from panels 32 and 34 by 180° inward folds F2, both of which extend horizontally. Inner headboard panel 32 may have a pair of long narrow slot cuts(not shown) extending along the side edges from the top edge and terminating short of fold line F2, to facilitate assembly. In any case, the blank 10 must have a cut between the panel 24 (at tab 28) and panel 32. This cut communicates with slot 26 to form a cut extending from the top edge of the blank (which is the top edge of panel 24) to the fold line F2 along a top edge of panel 20. Panel 32 also has a rectangular (or three sided) notched cut 38 which is centered on the panel's vertical centerline.

Panel 34 has a rectangular or three-sided notched cut 38 along its vertical centerline; this notched cut 38 is of the same size and shape as the notched cut 38 in panel 32. Panel 34 also has a pair of diagonal corner cuts 39, the cutout portions being triangular in shape. Outer headboard panel 30 and outer right side panel 20 are in side-by-side relationship, joined along a vertical fold line F1, which is a 90° inward fold. The height of panel 30 is the height of the headboard in the finished crib. The lower edge of panel 30 (which is along one fold line F2) is somewhat below the lower edge of panel 20, and the upper edge of panel 30 (along another fold line F2) is well above the upper edge of panel 20.

The third column of panels comprises panels 40, 42 and 44, which are vertically aligned. All of these panels are rectangular in shape (except for cutouts in panels 42 and 44) and extend from left to right. Panels 40, 42 and 44 have the same size and shape as panels 20, 22 and 24, respectively. Panels 40 and 44 form the outer left side panel and the inner left side panel, respectively, and are separated by a 180° inward fold F2. Panels 42 and 44 are separated by a 90° outward fold F3. Panel 44, together with panel 24 previously described, forms the bed of the crib. Long narrow slot cutouts 46 are provided on the left and right edges, respectively, of panels 42 and 44, extending over the entire height of panel 42 and most of the height of panel 44, terminating just short of the upper edge of panel 44. These cutouts 46 provide laterally extending locking tabs 48 along the top edge of panel 44.

The upper and lower edges of panels 40, 42 and 44 are aligned with the corresponding upper and lower edges of panels 20, 22 and 24, respectively. Panels 30 and 40 are in side-by-side relationship, and are joined along a vertical fold line F1.

The fourth or right hand column of panels includes outer footboard panel 50, inner footboard panel 52, which is above panel 50, and leg panel 54, which is below panel 50. Panel 50 is separated by panels 52 and 54 by horizontal 180° inward fold lines F2.

The height and width of panel 50 are the height and width, respectively, of the footboard in the assembled crib. Panel 50 has the same width as headboard panel 30 but a lesser height. Panels 50, 52 and 54 all have the same width, except for cutouts in panels 52 and 54. Panel 54 has exactly the same size and shape as the other leg panel 34.

Panel 52 may have a long narrow slot cutout (not shown) on the left side edge only, starting at the top edge and extending downwardly but terminating short of the lower edge, which is along fold line F2. In any case, there must a cut between panel 44 (at tab 48) and panel 52. Similarly, there is a cut between panel 44 (at tab 48) and panel 32. These cuts, together with the slots 46, provide cuts extending vertically from the top edge of blank 10 to the fold line F2 at the top edge of panel 40. Panel 52 also has a three sided (or rectangular) notch cutout 57 along the vertical centerline of the panel. Panel 54 has a three sided (or rectangular) notch cutout 58 along its centerline, and a pair of diagonal (or triangular) corner cutouts 59.

All four notch cutouts 37, 38, 57 and 58 are of the same size and shape, the cutout portions in each case are rectangular. All corner cuts 39 and 59 are also of the same size and shape; i.e. the triangles cut out in each case are congruent.

A tab 60, hereinafter known as a "glue tab", is joined to outer right side panel 20 by a vertical 90° inward fold line F1. The purpose of tab 60 is to receive glue on its white side and to provide a means for securing the right side panel 20 to the inner or brown side of outer footboard panel 50 to form a closure.

The letters A, B, C, and D may be embossed on panels as shown in FIG. 1 as an aid in assembling the crib. These letters are keyed to printed instructions which are furnished with the blank. Letter A is embossed on panels 34 and 54 along the respective lower edges thereof Letter B is embossed on panels 32 and 52 close to the upper edges thereof. Letters C and D are embossed adjacent to the upper edges of panels 24 and 44, respectively.

The assembled crib according to the first embodiment may be held together by glue, which is applied to the glue tab 60 and certain panels. Embossed dots E (as shown on panels 20, 30 and 32) may be provided on panels 20, 30, 32, 40 and 50 to denote the lines along which hot melt adhesive should be applied. These dots E, which form dotted lines, are adjacent to both the upper and lower edges of panels 20 and 40, to the upper edges of panel 30 and 50, and to the lower edges of panels 32 and 52.

It will be understood that the assembled crib, and therefore blank 10, may be of any convenient size. By way of specific example, a preferred crib according to this invention is made from corrugated cardboard, approximately ⅛ inch (3.2 mm) thick of conventional corrugated cardboard construction, comprising a flat white ply, a flat brown ply spaced therefrom and a corrugated brown paper layer therebetween. Nominal dimensions may be as shown in Table I below. Dimensions shown in Table I below always list the width (as seen from left to right in FIG. 1) first, then the height of each panel. Dimensions are in inches

TABLE I

| Panel and Reference Numerals | Dimensions |
|---|---|
| Headboard (outer) 30 | 7" × 10¼" |
| Headboard (inner) 32 | 7" × 8½" |
| Footboard (outer) 50 | 7" × 8½" |
| Footboard (inner) 52 | 7" × 7" |
| Leg panels 34 and 54 | 7" × 7" |
| Sides (outer) 20 and 40 | 12" × 5" |
| Sides (inner) 22 and 42 | 12" × 5" |
| Base panels 24 and 44 | 12" × 4" |

TABLE I-continued

| Panel and Reference Numerals | Dimensions |
|---|---|
| Locking tabs widths (28 and 48) | 1" |
| Slot widths (26, 36, 46, and 56) | 3/16" to ¼" |

The dimensions given in Table I above are by way of illustration of a specific and preferred embodiment, and are not by way of limitation.

A blank having the dimensions shown in Table I may also have the following dimensions: distance from lower edges of panels 30 and 50 (along fold lines F2) to the lower edges of panels 20 and 40: 2" (this will also be the distance from the lower edges of side panels 20 and 40 to the supporting surface on which the finished crib is placed in the assembled crib).

While illustrative and preferred embodiment shown in FIG. 1 depicts a blank in which the footboard panels 50 and 52 are along one side edge (the right edge from the brown side, or the left edge as viewed from the white side), so that closure in the assembled article is effected between footboard panel 50 and a side panel 20, it will be understood that the positions of the headboard column (comprising panels 30, 32 and 34) and the footboard column (comprising panels 50, 52 and 54) as shown in FIG. 1 could be transposed so that closure is effected between the headboard panel and a side panel. Basically, the blank according to this invention comprises a headboard column (30,32 and 34) and footboard column (50, 52 and 54) which are non-adjacent, and a pair of side columns (20, 22 and 24, 40, 42 and 44) which are non-adjacent.

Figure 5:
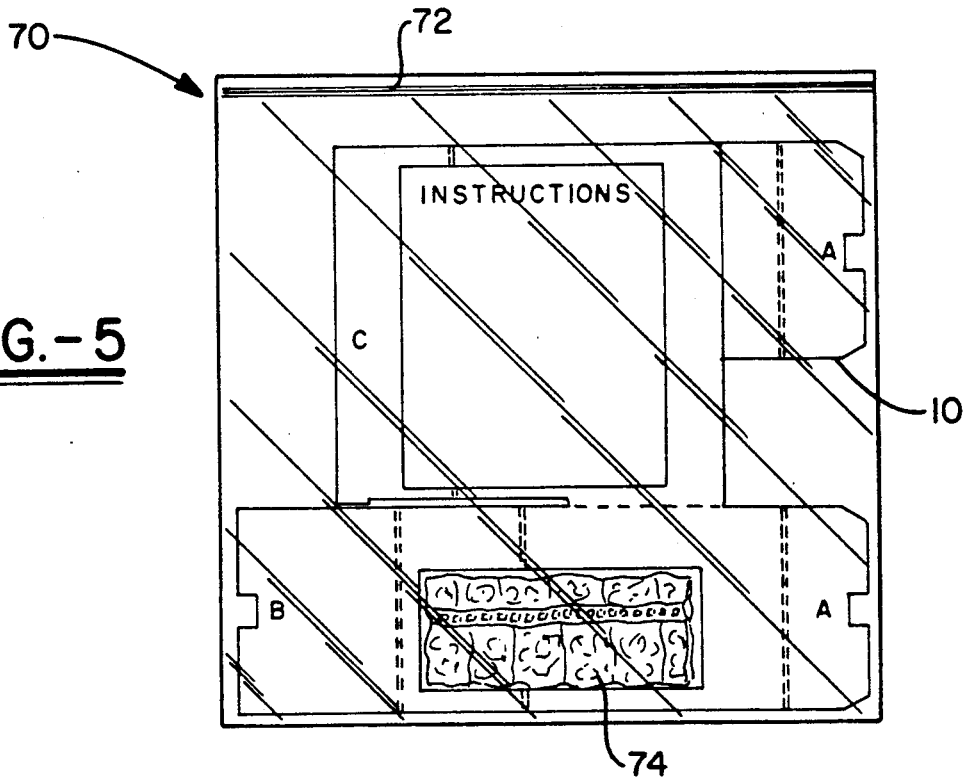
FIG. 5 is a plan view of a package or kit comprising a sealed outer envelope, a blank, decorative material and an instruction sheet which are contained within the envelope.

The blank 10 may be packaged and sold in the form of a kit which contains all the materials necessary for the purchaser (who may be either the retailer or the ultimate user) to assemble a crib according to this invention. This kit is shown in FIG. 5. Referring now to FIG. 5, kit 70 comprises a sealed flexible transparent plastic envelope 72 which contains a blank 10, a long strip of decorative lace 74 and an instruction sheet or pamphlet 76. The blank 10 is preferably folded along its central vertical fold line F1, between panels 30 and 40, so as to minimize the width of the package. Based on the preferred dimensions above, the overall width and height of blank 10 when flat are 38 inches in width and 21 ¾ inches in height; the blank when folded once along its vertical centerline is 19"×21 ¾". The dimensions of the envelope 72 must be just enough larger than this to receive the folded blank. The decorative lace strip 74 is preferably such that two tiers of lace, affixed horizontally, will completely cover the sides 20 and 40 and three tiers of lace, affixed horizontally, will completely cover the headboard 30 and footboard 50. Based on the preferred dimensions given above, a lace strip about 4 ¼ inch in width fulfills this requirement. This lace strip may comprise an asymmetrically positioned longitudinal joint or bead (which is closely woven) with lace ruffles of unequal widths extending form either side thereof. This is generically known as "double ruffled lace". When this lace is affixed to the surfaces of the assembled bed, as will be hereinafter described, the lace is affixed to an adhesive along this bead with the wider lace ruffle extending downwardly. The length of lace supplied should be sufficient to cover the entire outside surface of the finished crib. This length is at least 108 inches, based on the dimensions given above; preferably a length slightly in excess of this is supplied. The lace in kit 70 is preferably wound in a flat roll, either without a core or with a flat cardboard sheet core as desired.

Figure 6:
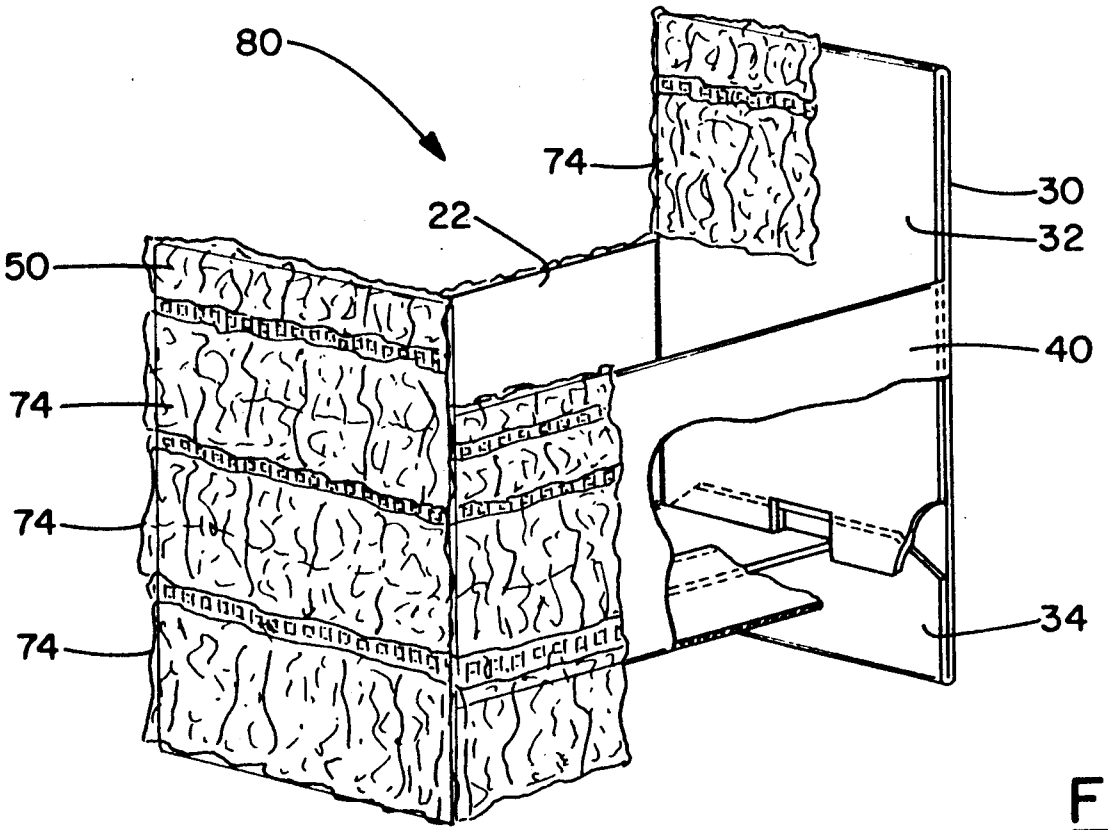
FIG. 6 is a perspective view of a finished and decorated article in accordance with this invention, in which portions of the decorated material have been broken away.

The assembled crib is shown in FIG. 6. As shown in FIG. 6, the finished crib 80 comprises a vertical headboard, a vertical footboard and two vertical sides, all of which are rectangular. The lower edges of the headboard and footboard may rest on a supporting surface (not shown) such as a tabletop. The two sides, which extend from the headboard to the footboard, will lie entirely above this supporting surface. Visible in FIG. 6 are the inner headboard panel 32, the outer footboard panel 50 (which is completely lace covered), the inner right side panel 22, the outer left side panel 40, and the leg panel 34 at the head end. Shown in edge only is the outer headboard panel 34. As shown in FIG. 6, the outer side panels 40 and 20 (the latter not visible in FIG. 6) are completely lace covered; this requires two tiers which extend horizontally. The outer headboard panel 30 is also completely lace covered; this requires three horizontal tiers of lace 74. The outer footboard panel 50 is also completely lace covered; this requires three horizontal tiers of lace 74. The top portion of the inner headboard panel 32, from the top edge thereof down to the top edges of the side panels, are preferably lace covered with a single horizontal tier of lace. Lace covering the upper portion of the inner footboard panel 52 above the top edges of the side panels, is optional; one tier of lace is required when used. The two lowermost tiers of lace may extend around the entire perimeter of the crib instead of being applied separately to each panel. The lower edge of the lowermost tier of lace preferably just touches the supporting surface (and therefore just reaches the lower edges of outer headboard panel 30 and footboard panel 50).

The finished crib 80 (FIG. 6) may be assembled from the preferred blank 10 as follows:

1. Place the blank 10 on a flat surface, brown side up.

2. Pre-break and fold all flats and locks. Note that the folds F3 along the lower edges of panels 24 and 44 (which may be labeled C and D, respectively, by means of embossed letters) are folded "white to white", i.e. outwardly as seen from the brown side (or inwardly as seen from the white side in the assembled crib 80). All other folds (FI and F2) are "brown to brown", i.e. inward as seen from the brown side (and therefore outward as seen from the white side in the assembled, crib 80). Use scissors to free the locking tabs 28 and 48 from the adjacent headboard and footboard panels 32 and 52, respectively, if necessary.

*2a*. Fold the blank white side out, until the glue tab 60 touches the inside or brown side of outer headboard panel 30. Apply hot melt adhesive (glue) to the white side of the glue tab, and affix the glued surface of the glue tab to the brown side of the outer headboard panel 30.

The preferred blank 10 may be pre-assembled to the extent of carrying out steps 1, 2 and *2a* (above) at the factory. The remaining steps must be carried out by a purchaser, either a retailer or the ultimate user.

3. "Square up" the folded blank and push inward to form a rectangle. Note that the area enclosed by the headboard, the footboard and the two sides is a rectangle.

4. Fold the two leg panels 34 and 54 (both embossed with the letter "A") inward. These form the base or the legs of the crib. Then fold the headboard inner panel 32 and the footboard inner panel 52 (both labeled with the embossed letter "B" inward. Panels 32 and 52 should overlap panels 34 and 54, respectively. The notches 37 and 57 in panels 32 and 52, plus notches 38 and 58, forme locking receptacles for locking tabs 28 and 48. Insert locking tabs 28 and 48 into slots 37, 38 57 and 58. Fold the like panels (both of which have a letter "A" embossed thereon) inward 180°. These panels form the legs of the crib. Fold the inner headboard and footboard, panels 32 and 52, respectively (both of which have the letter "B" embossed thereon) inward. These panels 32 and 52 will overlap panels 34 and 54 and the notches 37, 38 (in panels 32 and 34, respectively) and 57, 58 (in panels 52 and 54, respectively) will form slots to hold the locking tabs 28 and 48 in panels 24 and 44, respectively, in place.

5. To increase the holding strength of the crib bed, apply a strip of hot melt glue approximately one inch wide over the entire width of panel 24 from one lock tab 28 to the other locking tab.

6. Fold the other bed panel 44 outwardly (white to white) 90° along fold line F3. Then fold inner side panel 42 inward 180° (brown to brown) along fold line F2, then gently fold down the bed panel 44. The locking tabs 48 will lock into the slots formed by notches 37, 38 and 57, 58. Press down so that the brown side of panel 44 bonds with the hot melt glue applied to the white side of panel 24 in step 5. The crib is now complete.

The crib bed can be reinforced by adding three 10" strips of clear carton sealing tape, spaced approximately 2" apart, from the lower hot melt glue line "E" on the outside of the crib (i.e., on the white or outside surface of one of the two side panels 20 and 40), across the bottom of the crib bed (i.e., on the underside or brown side of panels 24 and 44) and up the opposite side (panel 40 or 20).

To decorate the crib 80, one first cuts two 39" length and two 15" lengths of the double ruffled white lace 74. Then one proceeds as follows:

1. The embossed dotted lines "E" on the panels 20 and 40 indicate the hot melt glue bead lines to which the lace is to be attached. Stretch one 39" length of lace gently to fluff out the ruffles. Starting at the middle of the back side of headboard (on panel 30) on the lower line, apply hot melt glue, one panel at a time, then attach the lace, working around the crib until the entire lower line (including headboard panel 30, right side panel 20, footboard panel 50, left side panel 40 and back to the headboard panel 30) is covered and completed.

2. Repeat the procedure of step 1 on the upper embossed dotted glue line "E". The crib body is done. The lace will show approximately ½" to ¾" above the top edges of the side panels.

3. Headboard: starting in the middle section on the back side of the headboard, lay down a bead of hot melt glue on the embossed dotted line "E" around the entire headboard (panels 30 and 32). Attach white lace. Approximately ¾" of lace will show above the top edge of the headboard.

4. Footboard: starting in the middle of the outer panel 50 of the footboard, lay down a bead of hot melt glue on the embossed dotted line "E" around the footboard (panels 50 and 52). Attach lace. Approximately ¾" of lace will show above the top edge of the footboard.

5. One may add decorative flourishes (such as bows) if desired in appropriate color or colors—whatever the occasion calls for. Attach these with hot melt glue. One may place a cloth napkin or a colored paper in the crib bed if desired. This completes the decorated crib as shown in FIG. 6 herein.

A blank having a mechanical lock instead of a glue tab to hold the crib together may be used. Three such mechanical locks will now be described.

Figure 2:
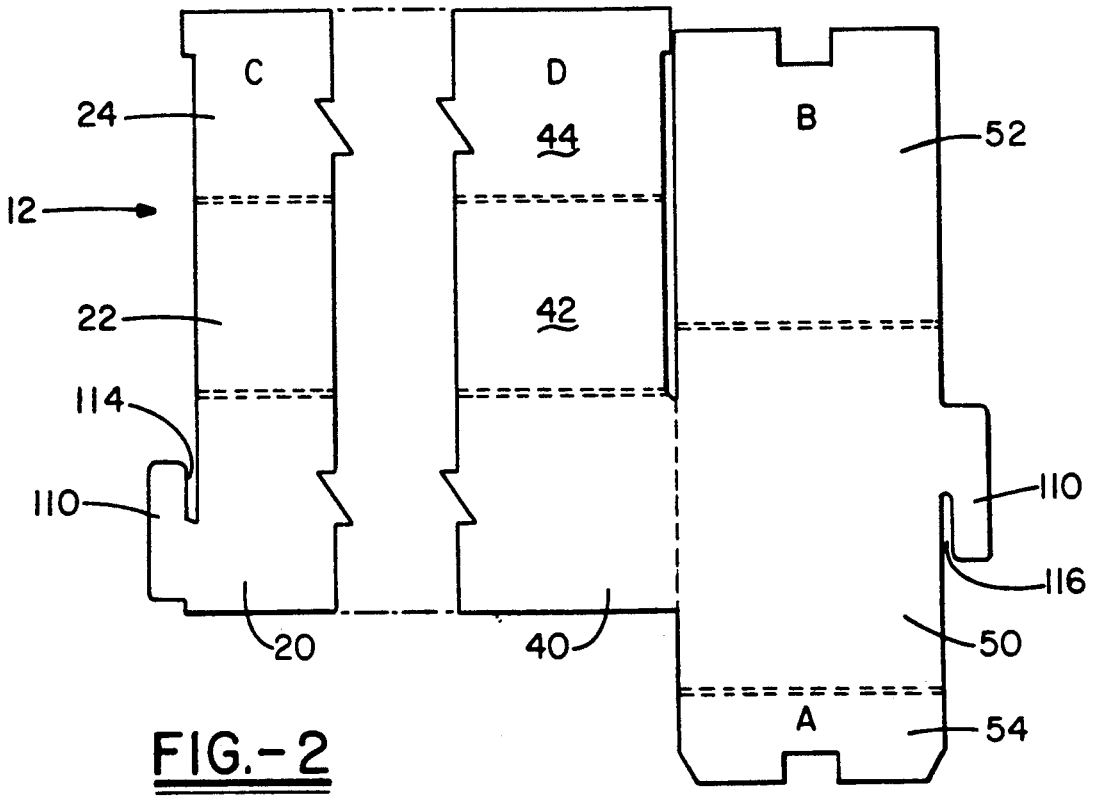
FIG. 2 is a fragmentary plan view of a blank according to a second embodiment of this invention.

FIG. 2 is a fragmentary view of an alternative blank 12 having a slot lock instead of a glue tab. The slot lock comprises a first, upwardly directed tab 110, which is attached via a fold line F1 to the lower portion of panel 20, and a complementary downwardly extending tab 112, which is attached via a fold line F1 to the upper portion of footboard panel 50 (but below the top edges of panels 20 and 40). Long, narrow slots 114 and 116 separate tabs 110 and 112 from the adjacent panels 20 and 50, respectively. Slot 114 is disposed beside the upper portion of tab 110 and above the fold line F1; slot 116 is disposed alongside the lower portion of tab 112 and below fold line F1. When panels 20 and 50 are brought together during the course of assembly, these slots are inserted into each other (by pushing the right side panel 20 down slightly and the headboard panel 50 up slightly then aligning the two slots so that they are inserted into each other, then pushing the side panel 20 up and the headboard panel 50 down). Both tabs are concealed in the crib as assembled, since tab 110 will be behind the footboard 50 (between panels 50 and 52) and tab 112 will be behind the outer side panel 20 (between panels 20 and 22). Glue for additional strength is optional. The remainder of blank 12 is the same as blank 10, and so is not described in detail. The method of assembly starting with blank 12 is the same as the method starting with blank 10, except for the above described step of engaging tabs 110 and 112 to form a lock, which replaces the step of gluing the glue tab to the inside (brown) surface of the footboard (panel 50). The assembled but undecorated crib appears essentially as that resulting when one starts with a blank 10, except that on close examination one can see small portions of tabs 110 and 112, adjacent the folds F1. After decoration, there is no visible difference.

Figure 3:
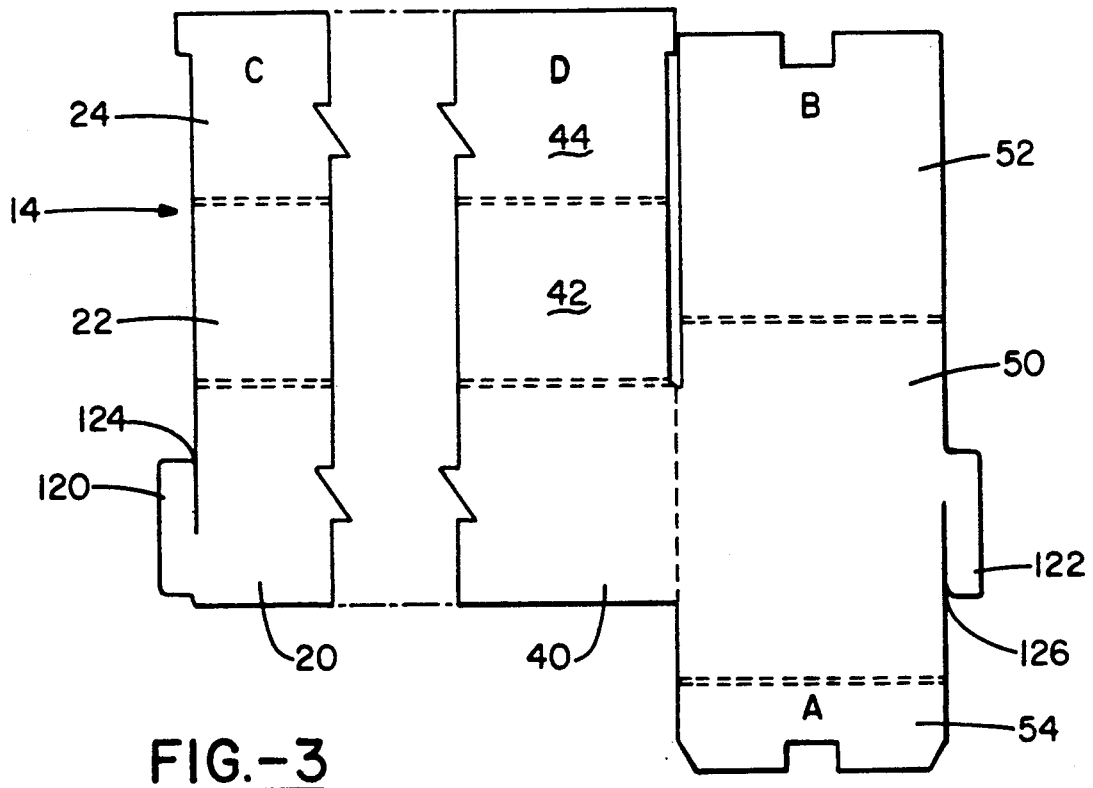
FIG. 3 is a fragmentary plan view according to a third embodiment of this invention.

FIG. 3 shows a fragmentary view of a third blank 14, in which a slit lock replaces the slot lock of FIG. 2. Referring now to FIG. 3, an upwardly pointing tab 120, attached to panel 20, and a downwardly pointing tab 122, attached to panel 50, replace tabs 110 and 112, respectively. Tabs 120 and 122 are joined to their respective panels along fold lines F1 at the same locations as the corresponding fold lines in FIG. 2. Slits 124 and 126 replace slots 114 and 116, respectively of FIG. 2. (The difference between a slit and a slot is that no material is cut away from the tab in a slit, while a narrow strip of material is cut away from the edge of the tab closest to the adjacent panel in order to form the slot.) The method of assembly, the appearance of the undecorated crib and the appearance of the decorated crib are the same as in the embodiment of FIG. 2. Gluing for additional strength is optional.

Figure 4:
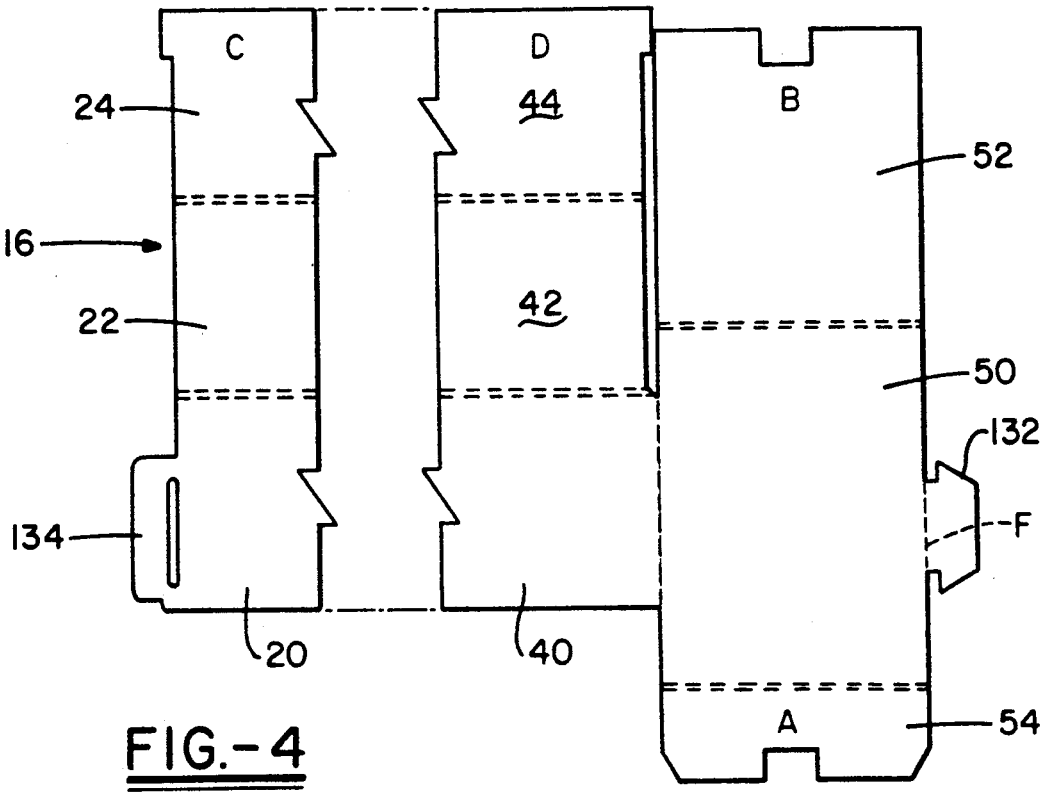
FIG. 4 is a fragmentary plan view according to a fourth embodiment of this invention.

FIG. 4 shows a further form of blank 14, in which the locks shown in FIGS. 2 and 3 are replaced by an arrow lock. The arrow lock comprises an arrow tab 132, which is attached to footboard panel 50 along a fold line Fl, and a generally jug handle shaped (or U shaped) tab 134, which is attached at its ends to right side panel 20. A narrow slot 136 between the midportion of tab 134 and the adjacent panel 20 receives the tongue portion of tab 132 in locking engagement. Gluing for additional strength is optional It will be appreciated that the glue tab arrangement shown in FIG. 1 and the various mechanical locking arrangement shown in FIGS. 2, 3, and 4 are all conventional types of closure arrangements known in the art for securing the two opposite sides or edges of a cardboard blank together in order to form a three dimensional article therefrom.

Alternative decorations may be used instead of the white lace ruffles described above. For example, festooned paper strips in which one of the two longitudinally extending side edges is cut with a large number of evenly spaced transverse cuts extending toward but stopping short of the other side edge, may replace the white lace. Other decorative materials can be used in addition to or instead of the lace shown. Finally, the outside surfaces (or white surfaces) of the crib 80 can be simply painted with any color or design, or it can even be left in their original white condition without painting or decoration. The last alternative is generally visually less pleasing than other alternatives.

The crib of this invention can be used for a variety of purposes, either as a container or receptacle or as a decorative item. For example, a preferred use according to this invention is as a container for a floral arrangement comprising cut flowers in supporting blocks which are saturated with water (e.g. "Oasis" block which is made my Smithers-Oasis division of the Smithers Company, Kent, Ohio). A plastic tray should be placed on the bed of the crib in this instance. Such an arrangement will weigh about seven to eight pounds (typically). However, a crib according to this invention is capable of supporting up to at least about 10 pounds of weight, especially when the bed is reinforced with tape as above described. The crib can also serve as a container for a small number (two or three) of flowers or plants in flower pots. Again, a plastic tray placed on the bed is desirable. The crib can also serve as a receptacle for greeting cards on festive occasions (such as baby showers, christenings, First Communion etc.). Alternatively, the crib may serve simply as an ornamental or decorative piece, and in this case one may place any desired decorations, such as a cloth napkin or colored paper, in the crib bed. Other uses will be apparent to those skilled in the art.

While this invention has been described with reference to the best mode and preferred embodiment therefore, it shall be understood that the foregoing description is by way of illustration and not limitation.

What is claimed is:

1. A blank for forming an ornamental article in the shape of a crib, said crib having an upright headboard, an upright footboard, and a pair of spaced parallel upright sides extending from said headboard to said footboard;

said blank having a plurality of essentially rectangular panels arranged in four columns which are in side-by-side relationship, the panels in each column being vertically aligned;

said blank having vertically extending cuts and vertical fold lines along the boundaries between columns, and horizontal fold liens between adjacent panels in the same column;

said columns comprising: a headboard column comprising an outer headboard panel and an inner headboard panel adjacent thereto; a footboard column comprising an outer footboard panel and an inner footboard panel adjacent thereto, said headboard column being non-adjacent; and a pair of nonadjacent side-forming columns, each of which comprises an outer side panel, an inner side panel adjacent thereto, and a bed-forming panel adjacent to said inner side panel, one of said side columns being interposed between said headboard column and side footboard column;

said outer headboard panel, one of said side panels, and said outer footboard being in side-by-side relationship, separated by vertical fold liens, said cuts extending form the top edge of the blank to the top edges of said outer side panels;

said headboard panels, said footboard panels and said side panels forming the headboard, the footboard and the sides, respectively, or a crib assembled form said blank;

said outer headboard panel, said outer footboard panel and said outer side panel each having an upper edge and a lower edge, the lower edges of said outer headboard panel and said outer footboard panel being lower than the lower edges of said outer side panels, and the upper edges of said outer headboard panel and said outer footboard panel being higher than the upper edges of said side panels;

the lower edges of a headboard and a footboard of a crib assembled from said blank being adapted to rest on a supporting surface, and the sides of said crib lying entirely above said supporting surface;

the bed-forming panels in said crib being in overlapping relationship.

2. A blank as in claim 1, wherein said headboard column and said footboard column each comprise a third panel attached to the lower edges of said outer headboard panel and said outer footboard panel respectively, said third panels being adapted to form legs of said crib; said bed-forming panels having laterally extending lock tabs and said inner headboard panel, said inner footboard panel and said third panels having notches along the outer edges thereof which form slots to receive said lock tabs in locking engagement.

3. A kit for assembly for an ornamental article in the shape of a crib, said kit comprising;

(a) a flexible outer envelope;

(b) a blank as claimed in claim 1;

(c) printed instructions for assembly; and said blank and said instructions for assembly being contained in said outer envelope.

4. A kit according to claim 3, further including decorative lace in strip form, said strip being of sufficient length to cover the entire outside surface of said article when assembled.

5. An ornamental article in the shape of a crib, said article being assembled from stiff sheet material, said article comprising a vertical headboard, a vertical footboard, and a pair of spaced vertical parallel sides extending from said headboard to said footboard, and a horizontal bed extending from one side to the other and from said headboard to said footboard;

said headboard, said footboard and said two sides each being formed by a pair of panels of said stiff sheet material which are in back to back relationship, one of said panels of each pair forming an outside surface and the other panel of each pair forming an inside surface, said article being formed from a blank as claimed in claim 1.

6. An article as claimed in claim 5, further including strips of decorative lace extending horizontally and affixed to the outside surfaces of said headboard, said footboard and said sides.

7. A blank as in claim 1, wherein the height of said outer footboard panel is less than the height of said outer headboard panel.

8. A blank as in claim 1, wherein said headboard panels and said footboard panels have the same width and said side panels have the same width, and wherein the width of said headboard and footboard panels is appreciably less that the width of said side panels.

* * * * *